United States Patent [19]

Kulka et al.

[11] Patent Number: 4,963,797

[45] Date of Patent: Oct. 16, 1990

[54] THERMAL PROTECTOR/RESISTOR COMBINATION

[75] Inventors: Robert Kulka, Livingston; Dinesh Chandra, Wayne, both of N.J.

[73] Assignee: Magnetek Unicersal Mfg. Corp., Paterson, N.J.

[21] Appl. No.: 353,245

[22] Filed: May 17, 1989

[51] Int. Cl.[5] ..... H05B 37/02

[52] U.S. Cl. ..... 315/309; 315/362; 361/57; 361/103

[58] Field of Search ..... 315/291, 309, 362; 361/54, 55, 57, 103

[56] References Cited

U.S. PATENT DOCUMENTS

| | | | |
|---|---|---|---|
| 2,246,890 | 6/1941 | Miller | 175/361 |
| 3,116,437 | 12/1963 | Harvey | 315/123 |
| 3,188,592 | 6/1965 | Kulka | 336/192 |
| 3,649,942 | 4/1972 | Plasko | 337/163 |
| 3,839,692 | 10/1974 | Plasko | 337/182 |
| 4,636,910 | 1/1987 | Chadwick | 361/103 |

FOREIGN PATENT DOCUMENTS 20537955 5/1971 Fed. Rep. of Germany .

*Primary Examiner*—Robert J. Pascal

*Attorney, Agent, or Firm*—Darby & Darby

[57] ABSTRACT

A ballast assembly has a thermal circuit protector with a resistor mounted in close proximity, for protecting multiple coils in a ballast assembly. The thermal circuit protector is included in the assembly, connected in series with a first coil. The resistor is connected in series with a second coil, with the resistor sized to produce sufficient heat during a high current draw condition to actuate a bimetallic switch within the adjacent protector, thereby interrupting power to the ballast assembly and preventing damage without requiring a second thermal circuit protector.

9 Claims, 2 Drawing Sheets

FIG. 1
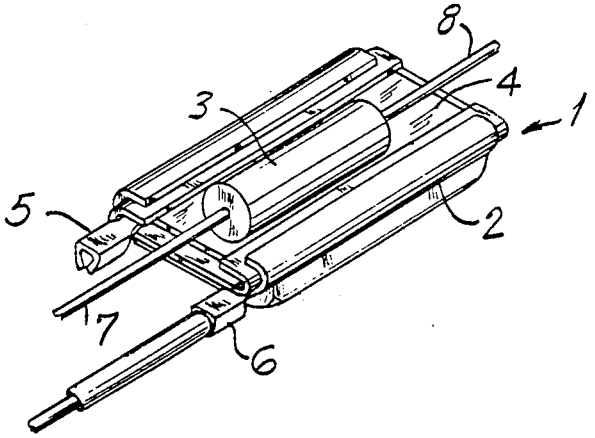
FIG. 2
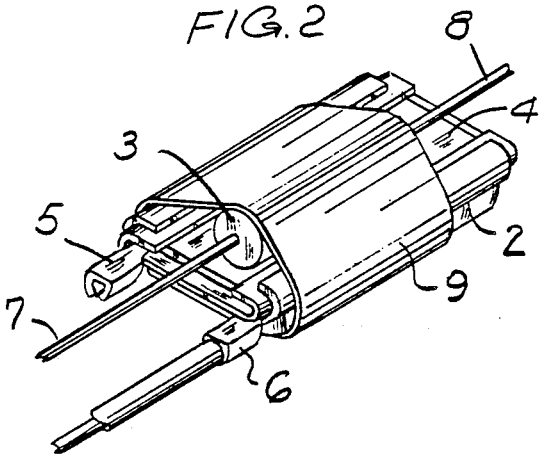
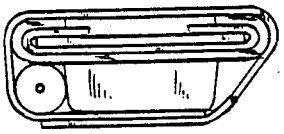
FIG. 5

THERMAL PROTECTOR/RESISTOR COMBINATION

TECHNICAL FIELD

This invention relates to ballast assemblies and more particularly to ballast assemblies including at least one thermal protection sensor which provides circuit disconnection during a current overload.

BACKGROUND

Ballast assemblies for two lamp instant start fluorescent lighting fixtures include primary and secondary coils for maintaining bulb illumination, with a starter coil providing a current boost for first charging the bulb and initiating fluorescence. The coils are all located in a common housing, with terminations and wiring provided for energizing the coils.

In a typical ballast assembly, a thermal circuit protector (TCP) is usually included as a safety device which may sense an abnormal increase in temperature in the assembly. Such a temperature increase is usually attributed to an overload or short circuit condition. The TCP prevents high temperatures from causing damage to the assembly, by interrupting the power supply to the ballast assembly.

The TCP has a bimetallic switch which is calibrated to open at a specified temperature and remain open while the temperature is above the calibrated limit. Upon returning to the set temperature, the TCP bimetallic switch closes, allowing normal operation to commence. TCP's with bimetallic switches are proximity devices which must be placed as close as possible to the heat source to provide quick response. Generally, the TCP is connected in the primary power supply to the transformer such that upon switch activation the TCP interrupts the power supply to prevent further overheating. Besides current overloads and short circuits, two-lamp instant start ballast assemblies have the additional problem of lamp rectification. Under lamp rectification, the current in the starter coil jumps from a nominal 80 milliamperes to approximately 200 milliamperes. To protect the assembly from damage, the starter coil requires a dedicated TCP. Thus, two TCPs are placed in the housing, one adjacent the primary coil and one adjacent the starter coil. Each TCP is wired in series with the power supply. Therefore, if one or the other or both coils are subjected to an abnormal temperature, the bimetallic switches will open, cutting power to the ballast assembly.

One problem with this arrangement is that each coil subject to overheating must have an adjacent TCP, with the number of TCPs increasing the cost of the ballast assembly. In addition, wiring and ballast assembly costs increase with the increase in component parts.

SUMMARY OF THE INVENTION

It is an object of the present invention to provide a ballast assembly which reduces the number of thermal circuit protectors needed in a ballast assembly without sacrificing protection in an overload condition.

It is another object of the present invention to provide means for protecting the starter coil in a ballast assembly without impeding current flow.

These and other objects of the present invention are achieved by providing a ballast assembly having a first coil and a second coil, a thermal circuit protector (TCP) disposed adjacent the first coil, the TCP having switch means connected between a power source and the first coil, a resistor, mounted on the TCP, the resistor electrically connected in series with the second coil allowing current to pass therethrough, during normal operation. The resistor has sufficient resistance to current flow to produce sufficient heat, during a high current draw condition, to actuate the switch means in the TCP, interrupting the power supply to the assembly.

BRIEF DESCRIPTION OF THE DRAWINGS

FIG. 1 shows a resistor mounted on the back of a thermal circuit protector.

FIG. 2 shows the resistor secured to the thermal circuit protector using tape.

FIG. 5 shows an alternative mounting arrangement of the resistor on the thermal circuit protector.

DETAILED DESCRIPTION OF THE INVENTION

Figure 3:
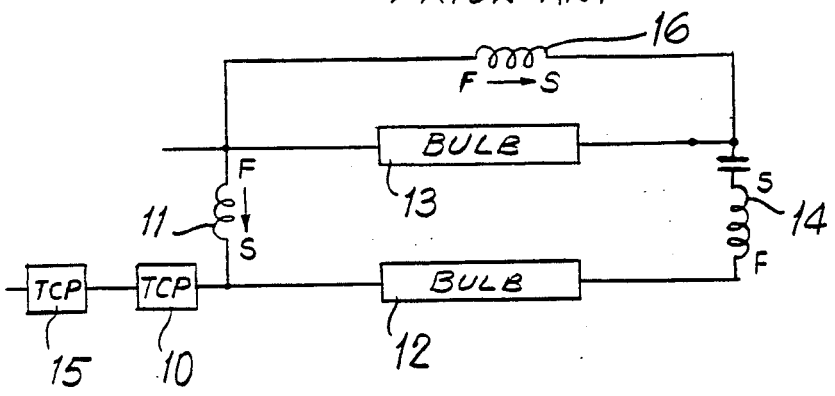
FIG. 3 PRIOR ART
FIG. 3 is a schematic illustration of a prior art two-TCP system.

Referring to FIG. 1, a thermal circuit protector/resistor combination 1 is shown. The combination 1 has a thermal circuit protector (TCP) 2 and a resistor 3. The TCP has an essentially flat back surface 4, and end terminations 5 and 6. The resistor 3 is placed in contact with the surface 4, to assure efficient heat transfer to the TCP. The resistor has leads 7 and 8 extending therefrom, for connection with a coil in a ballast assembly The resistor may be attached by gluing, taping or other means to assure continuous long-term contact with the TCP. Referring to FIG. 2, the resistor is held in place with tape 9.

Various thermal circuit protectors may be used with the present invention. For example, a thermal circuit protector made by Texas Instrument, Model 7AM series, which has a operating range of from 100°-115° C., is readily adaptable for mounting a resistor. Generally, the thermal circuit protector has an integral bimetallic switch which is responsive to changes in temperature, with the switch in the closed condition at lower temperatures (below a chosen temperature such as 100° C.) and opening, with a snap action, at higher temperatures (for example, above about 100° C.).

Resistors usable with the present invention may comprise any known type, including resistance wire or common carbon resistors. For example, a 10–40 ohm carbon composition resistor or film resistor of ½-2 watt typical is easily mounted on the above described TCP. Of course, other types of resistors may similarly be used so long as they have sufficient resistance to cause resistor heating in an amount sufficient to actuate the adjacent TCP.

The resistor may be mounted on the TCP either on its back or on its front or any other convenient location, so long as the resistor is in close proximity to the thermal circuit protector (actual contact is not required). Where resistance wire is used, it may be wrapped around the TCP. The resistor is wired in series with the auxiliary or starting coil of the ballast assembly and is sized to allow current to flow during normal operation. When a high draw current situation occurs, such as when lamp rectification occurs and the milliamperage increases, the resistor will heat up, to the point where it actuates the thermal circuit protector, shutting down the power supply to the ballast assembly. While the resistor is described as protecting a starter coil, it will be understood that the resistor may be placed in series with any electrical component which may potentially overload or be short circuited.

Referring to FIG. 3, a schematic of a prior art two bulb ballast assembly is shown. A first TCP 10 and a second TCP 15 are included in the supply to a primary coil 11. Two bulbs, 12 and 13, separate the primary coil from a secondary coil 14. The second TCP 15 is disposed in the supply to the primary coil, but is positioned next to a starter coil 16. Thus, two protectors are needed to assure safe operation of the ballast assembly.

Figure 4:
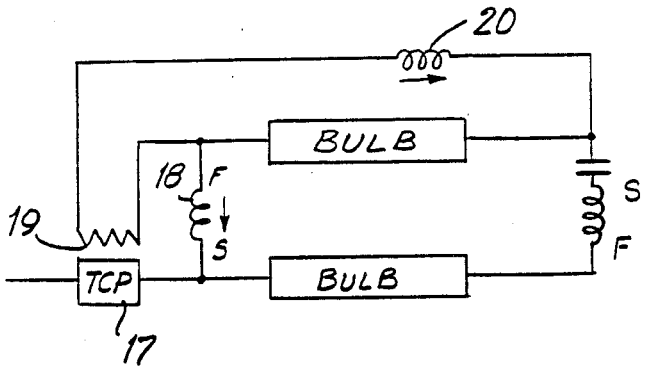
FIG. 4 is a schematic illustration of the TCP/resistor combination of the present invention.

Referring to FIG. 4, the inventive system is shown in schematic A thermal circuit protector 17 is located in the main feed to a primary coil 18. A resistor 19 is disposed in the main feed to a starter coil 20. However, the resistor 19 is placed adjacent the protector 17 such that high current flows will cause the resistor to heat up, actuating the protector to interrupt power to the primary coil 18, thereby protecting the ballast assembly without utilizing a second thermal circuit protector.

Figure 6:
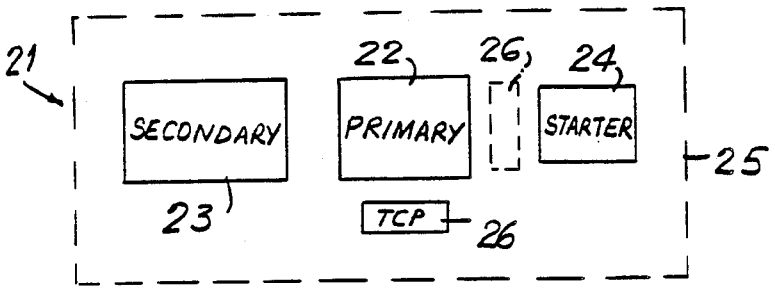
FIG. 6 is an illustrative view showing two mounting positions for the TCP/resistor combination in a ballast assembly.

Referring to FIG. 6, a ballast assembly 21 includes a primary coil 22, a secondary coil 23, and a starter coil 24. The coils are disposed in a housing 25. Each coil has a wire wound about a center of a bobbin which is surrounded by a magnetic core. The core is composed of a plurality of ferromagnetic laminations through which a magnetic flux is transmitted. Generally, wiring terminations are provided for connecting the coils to a power source as well as to the bulbs in a fluorescent lighting fixture. While various arrangements of the coils and terminations may be utilized in the housing, the above-described ballast assembly is considered typical.

Referring still to FIG. 6, various locations for mounting a thermal circuit protector/resistor combination 26 in the ballast assembly are shown. Generally, the combination 26 may be disposed between the starter coil and the primary coil or may be disposed adjacent the primary coil only. However, wherever the thermal protector is, a resistor is mounted thereon and wired in series with the starter coil 24.

Utilizing a resistor in combination with a thermal circuit protector reduces the cost for protecting a ballast assembly from overheating. In addition, the presence of the resistor in the auxiliary circuit overcomes the problem of lamp rectification by allowing current to flow during the starting condition yet providing a means for actuating the thermal circuit protector to prevent a continuous high draw of current.

While a particular resistor and thermal circuit protector were described, it will be understood by those skilled in the art that various other types of resistors and thermal circuit protectors could be utilized in the present invention without deviating from the scope thereof. It will also be understood that the resistor could be used in series with other potential heat generating devices, eliminating the need for individual proximity sensors. Also, more than one resistor could be mounted on a single TCP, further simplifying a ballast assembly.

We claim:

1. A ballast assembly having a first coil, a second coil and an auxiliary coil, a thermal circuit protector disposed adjacent the first coil, the protector having thermally responsive switch means integral therewith, the switch means connected between a power source and the coils, the ballast assembly further comprising:

resistor means, mounted on the protector, for resisting current flow, the resistor means electrically connected in series with the starter coil such that current passes therethrough without heating the resistor means during a low current draw condition, with the resistor producing sufficient heat during a high current draw condition to actuate the switch means in the protector, thereby interrupting the power supply to the assembly.

2. The assembly of claim 1 wherein the resistor means is a carbon composition resistor, film resistor or resistance wire.

3. The assembly of claim 1 wherein the resistor means is attached to the thermal circuit protector by tape

4. The assembly of claim 1 wherein the resistor means is mounted on a flat back side of the thermal circuit protector.

5. The assembly of claim 1 wherein the resistor means is mounted in continuous contact with a front surface of the thermal circuit protector.

6. The assembly of claim 1 wherein the resistor means is a 10–40 ohm carbon composition resistor of ½ watt.

7. The assembly of claim 1 wherein the thermal circuit protector resistor combination is mounted between the primary coil and the starter coil.

8. The assembly of claim 1 wherein the thermal circuit protector resistor combination is mounted adjacent the primary coil.

9. The assembly of claim 1 wherein more than one resistor means are mounted on the thermal circuit protector.

* * * * *